US007866941B2

(12) United States Patent
Li et al.

(10) Patent No.: US 7,866,941 B2
(45) Date of Patent: Jan. 11, 2011

(54) FAN WITH VIBRATION NOTIFICATION

(75) Inventors: Shi-Lin Li, Taoyuan Hsien (TW); Fu-Lei Yu, Taoyuan Hsien (TW); Jian-Long Li, Taoyuan Hsien (TW); Chih-Chang Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 881 days.

(21) Appl. No.: 11/808,873

(22) Filed: Jun. 13, 2007

(65) Prior Publication Data

US 2007/0297915 A1 Dec. 27, 2007

(30) Foreign Application Priority Data

Jun. 23, 2006 (TW) ..... 95122720 A

(51) Int. Cl.
*F01D 15/00* (2006.01)

(52) U.S. Cl. ..... 415/121.3; 310/81; 310/68 E

(58) Field of Classification Search ..... 415/118, 415/119, 121.3, 220, 232; 416/145, 146 R, 416/203, 248, 500; 361/695; 310/81, 68 E; 454/184, 906
See application file for complete search history.

(56) References Cited

FOREIGN PATENT DOCUMENTS

EP 1589637 A1 * 10/2005

* cited by examiner

*Primary Examiner*—Edward K Look
*Assistant Examiner*—Aaron R Eastman
(74) *Attorney, Agent, or Firm*—Birch, Stewart, Kolasch & Birch, LLP

(57) ABSTRACT

A fan comprises a ventilation device and a vibration device. The ventilation device comprises a housing, an impeller disposed in the housing and rotating with respect to a rotating center, and a driving mechanism disposed in the housing and connected to the impeller to rotate the impeller. The vibration device is disposed on the impeller and comprises at least one fixed element, at least one movable element, and at least one track. The fixed element is fixed to the track, and the movable element is slidably disposed on the track. When the movable element slides on the track, a vibration notification is generated.

20 Claims, 8 Drawing Sheets

FAN WITH VIBRATION NOTIFICATION

BACKGROUND OF THE INVENTION

This Non-provisional application claims priority under U.S.C.§119(a) on Patent Application No(s). 095122720 filed in Taiwan, Republic of China on Jun. 23, 2006, the entire contents of which are hereby incorporated by reference.

1. Field of the Invention

The invention relates to a fan, and in particular relates to a fan with vibration notification and well heat-dissipation functions.

2. Description of the Related Art

Vibration notification has become a standard function used in mobile phones. Motors for vibration, therefore, are essential elements for mobile phones.

In addition, as high efficiency of mobile phones is increasingly demanded, heat dissipation devices or heat dissipation systems have also become essential, especially for microelectronic elements, such as integrated circuits. Since the area of an integrated circuit becomes smaller and smaller because of requirements of high integration and efficient packaging, heat generated increases accordingly.

In general, certain heat dissipation mechanisms, such as heat pipes or fins, are employed for heat dissipation. This does, however, occupy more space and increase volume and weight of the devices. In addition, a heat conductive material, such as alloys of magnesium and aluminum, is also applied in manufacture of housings of mobile phones for promoting heat dissipation efficiency, but such material cost a lot.

Fans are another option for heat dissipation in mobile phone if fans are compact enough and provided with vibration notification.

BRIEF SUMMARY OF INVENTION

A detailed description is given in the following embodiments with reference to the accompanying drawings.

An embodiment of a fan of the invention includes a ventilation device and a vibration device. The ventilation device includes a housing, an impeller, and a driving mechanism, wherein the impeller and the driving mechanism are disposed in the housing, and the driving mechanism is connected to the impeller to drive the impeller to rotate. The vibration device is disposed on the impeller and includes at least one fixed element, at least one movable element, and at least two tracks. The fixed element is fixed to one of the tracks, and the movable element is slidably disposed in the other of the tracks. When the movable element slides on the track, a vibration notification is generated.

The vibration device can be integrally formed with the ventilation device as a single piece, or the vibration device is an individual device and joined to the ventilation device. When the vibration device is integrally formed with the ventilation device as a single piece, the tracks are formed on the impeller and are disposed symmetrically with respect to a rotating center of the impeller. The impeller includes a hub and a plurality of blades disposed on a periphery of the hub, and the track is formed on the hub. The blades are integrally formed with the hub, and each blade has a gradually-rising profile.

When the vibration device is an individual device and joined to the ventilation device, the vibration device further includes a base where the tracks are formed thereon, and the vibration device is connected to the ventilation device through the base. The tracks are disposed symmetrically with respect to a rotating center of the impeller. A plurality of blades is disposed on the periphery of the hub. The base is disposed on an upper surface of the hub of the impeller by attachment or adhesion, so that the vibration device is connected to the ventilation device. The blades are integrally formed with the hub, and each blade has a gradually-rising profile.

Further, the vibration device includes a cover disposed above the tracks to seal the tracks. The cover is fixed above the tracks by gluing, bonding or engaging. The cover is made of plastic, acrylic, ceramic, metal or alloy.

A sum of number of the fixed element and the movable element is the same as a number of the tracks. The number of the fixed element is greater than, equal to or less than a number of the movable element. The shape, size, and weight of the fixed element are the same as or different from that of the movable element.

The fixed element and the movable element are permanent magnets, and an attracting force is generated when the fixed element and the movable element are relatively disposed. In another embodiment, the fixed element is a soft magnet, and the movable element is a permanent magnet, or vice versa. The vibration device includes a plurality of fixed elements and a plurality of movable elements, wherein some of the fixed elements are soft magnets and the others are permanent magnets, and some of the movable elements are soft magnets and the others are permanent magnets. The fixed element is fixed to on of the tracks by gluing, bonding or engaging.

In the present invention, such vibration device is incorporated into a fan. Such a structure can be applied to mobile phones for space and cost conservation.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
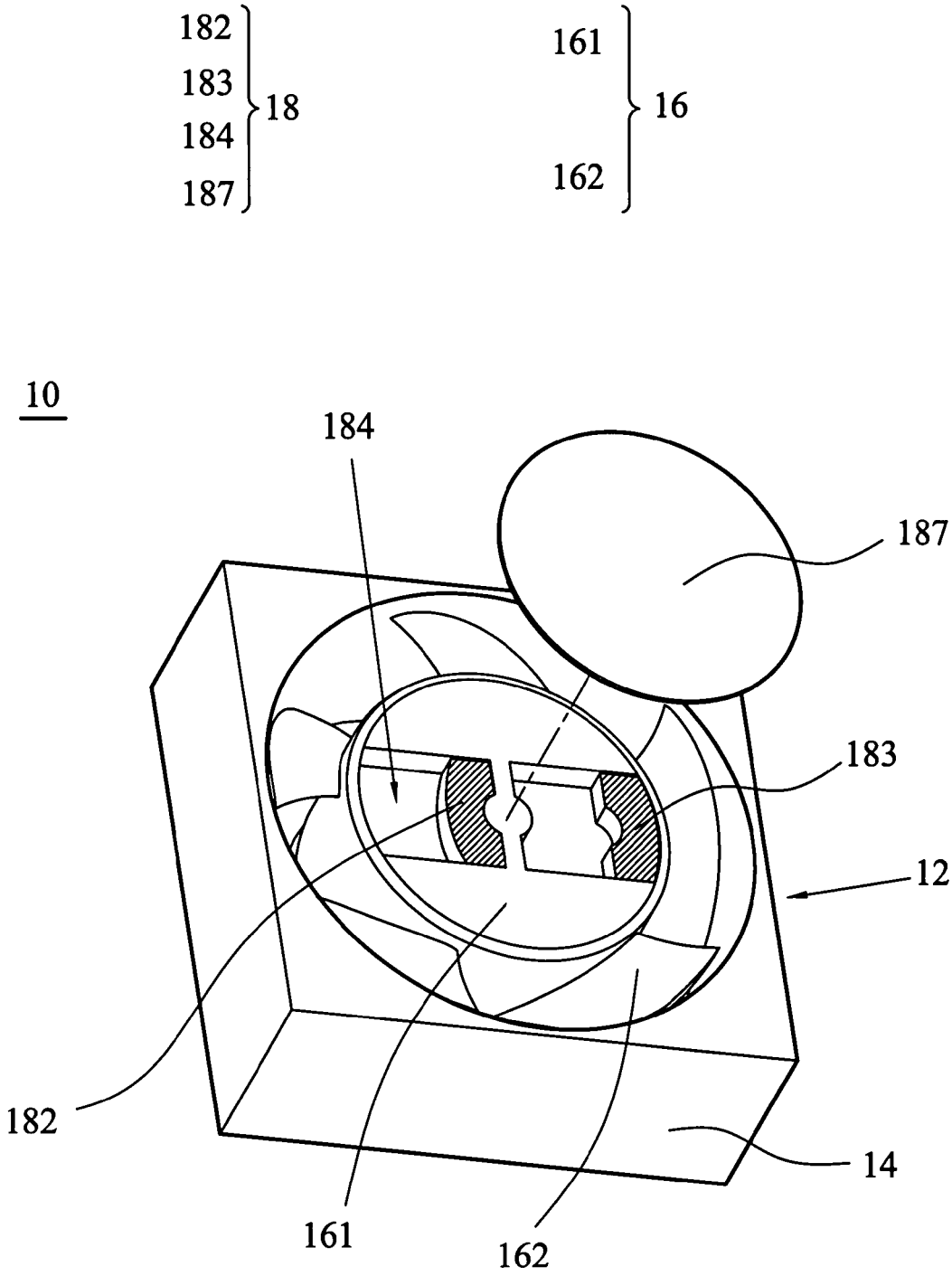
FIG. 1 is an exploded view of a fan according to the preferred embodiment of the present invention.

Referring to FIG. 1, a fan 10 according to the preferred embodiment of the present invention, such as an axial flow fan, includes a ventilation device 12 for heat dissipation and a vibration device 18 for vibration notification. The ventilation device 12 includes a housing 14, an impeller 16 and a driving mechanism, such as a motor. The impeller 16 and the driving mechanism are accommodated in the housing 14. The impeller 16 has a hub 161 and a plurality of blades 162 disposed on the periphery of the hub 161. The driving mechanism is connected to the impeller 16 for driving the impeller 16 to rotate.

The vibration device 18 is disposed on the impeller 16 and the vibration device 18 includes at least one fixed element 182, at least one movable element 183, at least two tracks 184 and a cover 187. The fixed element 182 is fixed on one of the tracks 184 by gluing, bonding or engaging. The movable element 183 is disposed in the other of the tracks 184 and is capable of sliding thereon as to generate a vibration notification.

In FIG. 1, the ventilation device 12 and the vibration device 18 are integrally formed as a single piece. The tracks 184 are formed on the impeller 16 and the tracks 184 are disposed symmetrically with respect to a rotating center X of the impeller 16. The cover 187 is disposed above the tracks 184 so as to seal the tracks 184. The cover 187 can be a thin hard plastic sheet fixed above the tracks 184 by gluing, bonding or engaging so as to seal the fixed element 182 and the movable element 183 in the tracks 184.

In FIG. 1, the tracks 184 can be disposed directly on the hub 161. The blades 162 are integrally formed with the hub 161 as a single piece. Each blade 162 has a gradually-rising profile. The impeller 16 can be made of plastic, acrylic, ceramic, metal or alloy.

Figure 2:
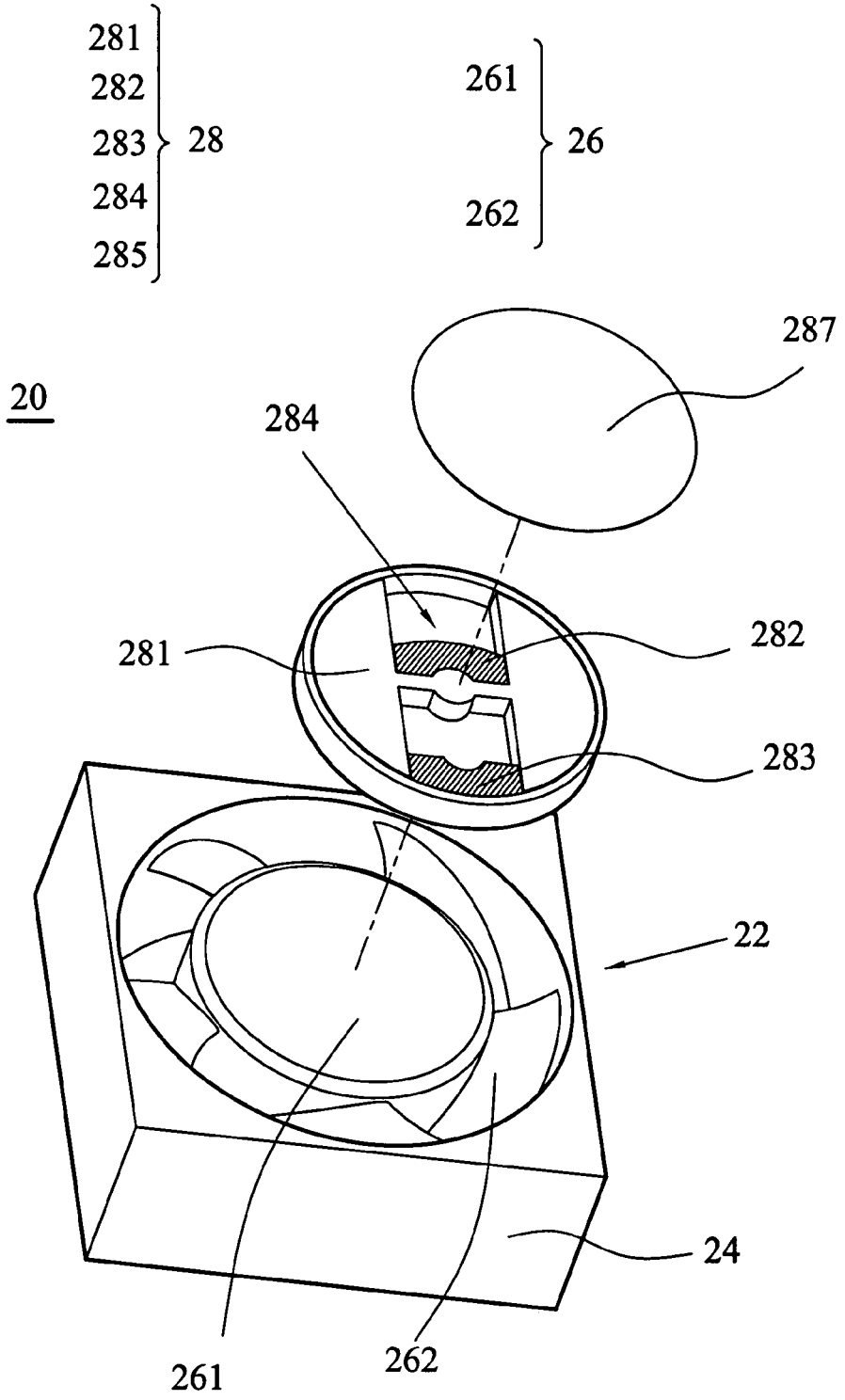
FIG. 2 is a schematic view of another fan according to the preferred embodiment of the present invention.

Except for designing that the vibration device is integrally formed with the ventilation device as a single piece, the vibration device can be an individual device and joined to the ventilation device. That is to say, the ventilation device and the vibration device can also be two individual devices. The vibration device can be designed as a standard component and joined to the ventilation device. The vibration device can be applied to a micro-fan which is used in notebooks. Referring to FIG. 2, another fan according to the preferred embodiment of the present invention is disclosed. In FIG. 2, a fan 20 includes a ventilation deice 22 and a vibration device 28. The ventilation device 22 includes a housing 24, an impeller 26 and a driving mechanism, such as a motor. The impeller 26 and the driving mechanism are accommodated in the housing 24. The impeller 26 includes a hub 261 and a plurality of blades 262 disposed on the periphery of the hub 261. The driving mechanism is connected to the impeller 26 and drives the impeller 26 to rotate.

The vibration device 28 is disposed on the impeller 26 and the vibration device 28 has a base 281, at least one fixed element 282, at least one movable element 283, at least two tracks 284 and a cover 287. The tracks 284 are formed on the base 281 and fixed on the hub 261 through the base 281 by gluing, bonding or engaging, whereby the vibration device 28 is joined to the impeller 26. The track 284 are disposed symmetrically with respect to a rotating center X of the impeller 26. The cover 287 is disposed above the tracks 284 so as to seal the tracks 284. The cover 287 can be a thin hard plastic sheet fixed above the tracks 284 by gluing, bonding or engaging so as to seal the fixed element 282 and the movable element 283 in the tracks 284. The cover 287 and the base 281 can be made of plastic, acrylic, ceramic, metal or alloy. The fixed element 282 is fixed to one of the tracks 284 by gluing, bonding or engaging. The movable element 283 is disposed in the other of the tracks 284 and capable of sliding thereon as to generate a vibration notification.

The impeller 26 includes a hub 261 and a plurality of blades 262 disposed on the periphery of the hub 261. The base 281 is disposed on an upper surface of the hub 261 and is connected to the hub 261 by attachment or adhesion, so that the vibration device 28 is connected to the ventilation device 22. The impeller 26 can be made of plastic, acrylic, ceramic, metal or alloy.

Therefore, both of the fan 10 of FIG. 1 and the fan 20 of FIG. 2 can provide vibration notification and heat dissipating functions. The fixed element 182/282 has the same size and weight as the movable element 183/283. The fixed element 182/282 and the movable element 183/283 can be permanent magnets, or one is a permanent magnet and the other is a soft magnet. When the fixed element 182/282 and the movable element are relatively disposed, an attracting force is generated. The fixed element 182/282 is disposed in and fixed to one of the tracks 184/284, and the movable element 182/283 is freely disposed in the other track 184/284, which is disposed symmetrically with the track 184/284 where the fixed element 182/282 is disposed with respect to a rotating center X of the impeller 26.

Figure 3A:
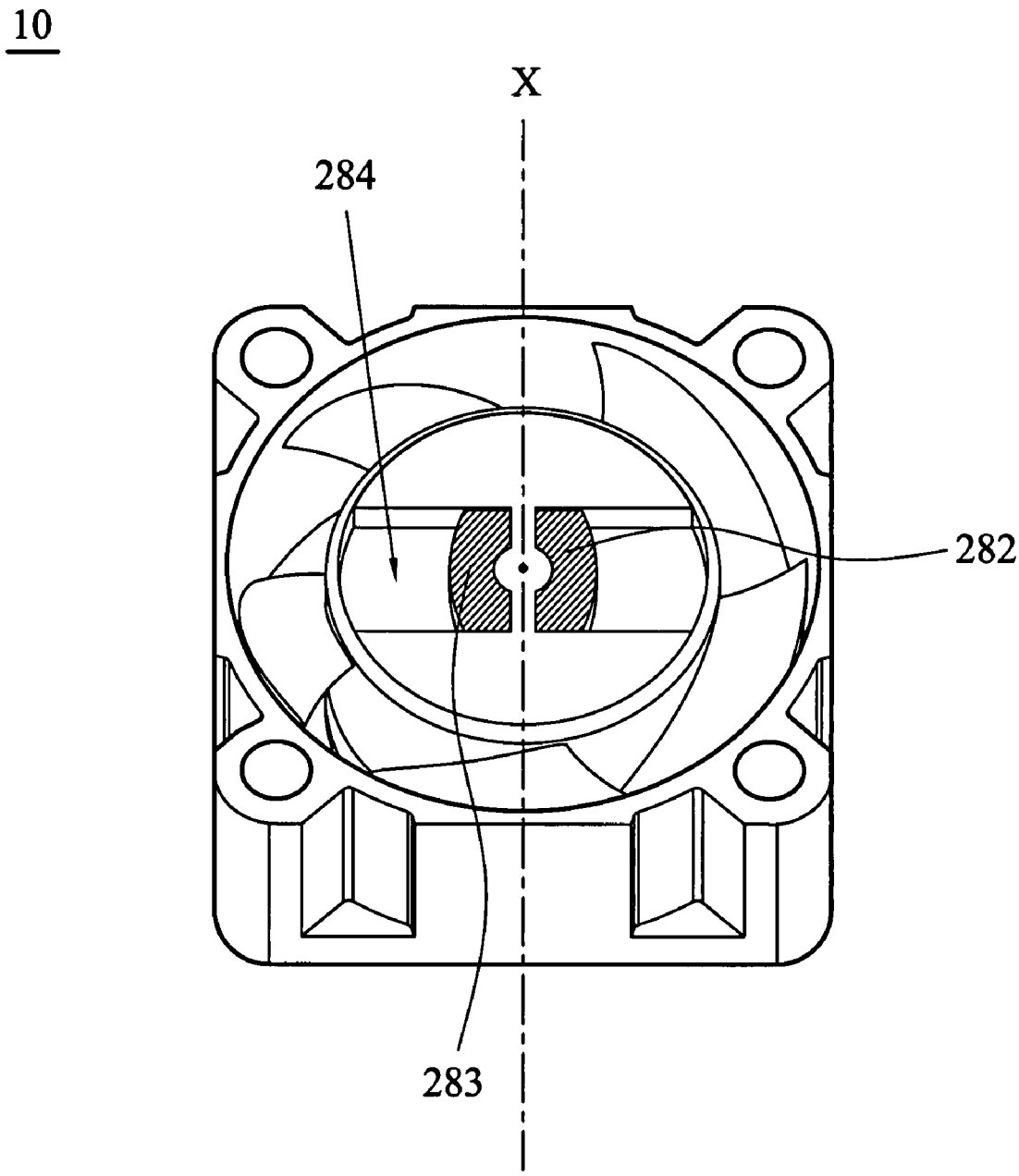
FIG. 3A depicts the impeller of the fan of FIG. 1 in a stable state.
Figure 3B:
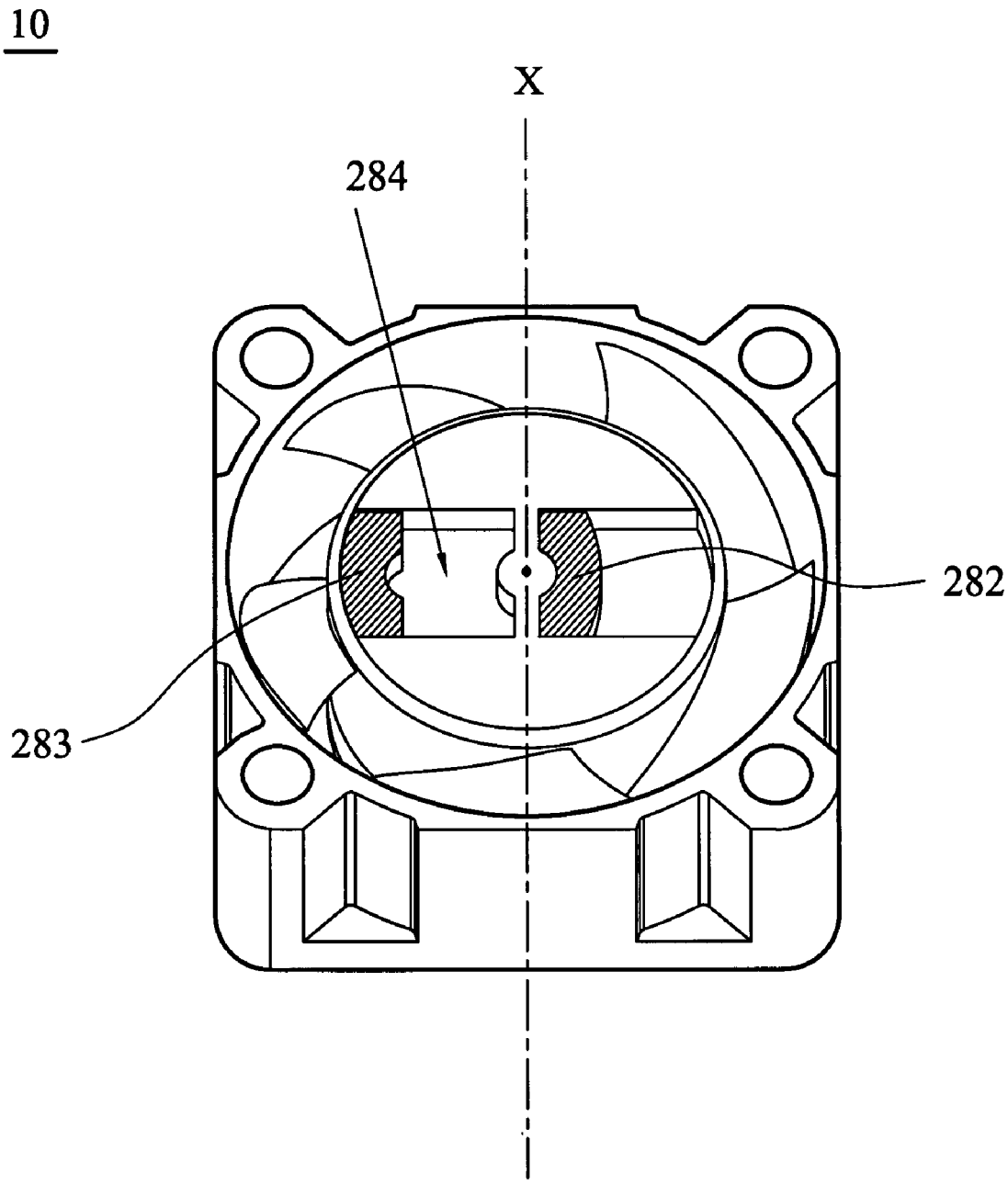
FIG. 3B depicts the impeller of the fan of FIG. 1 in a unstable state.
Figure 4:
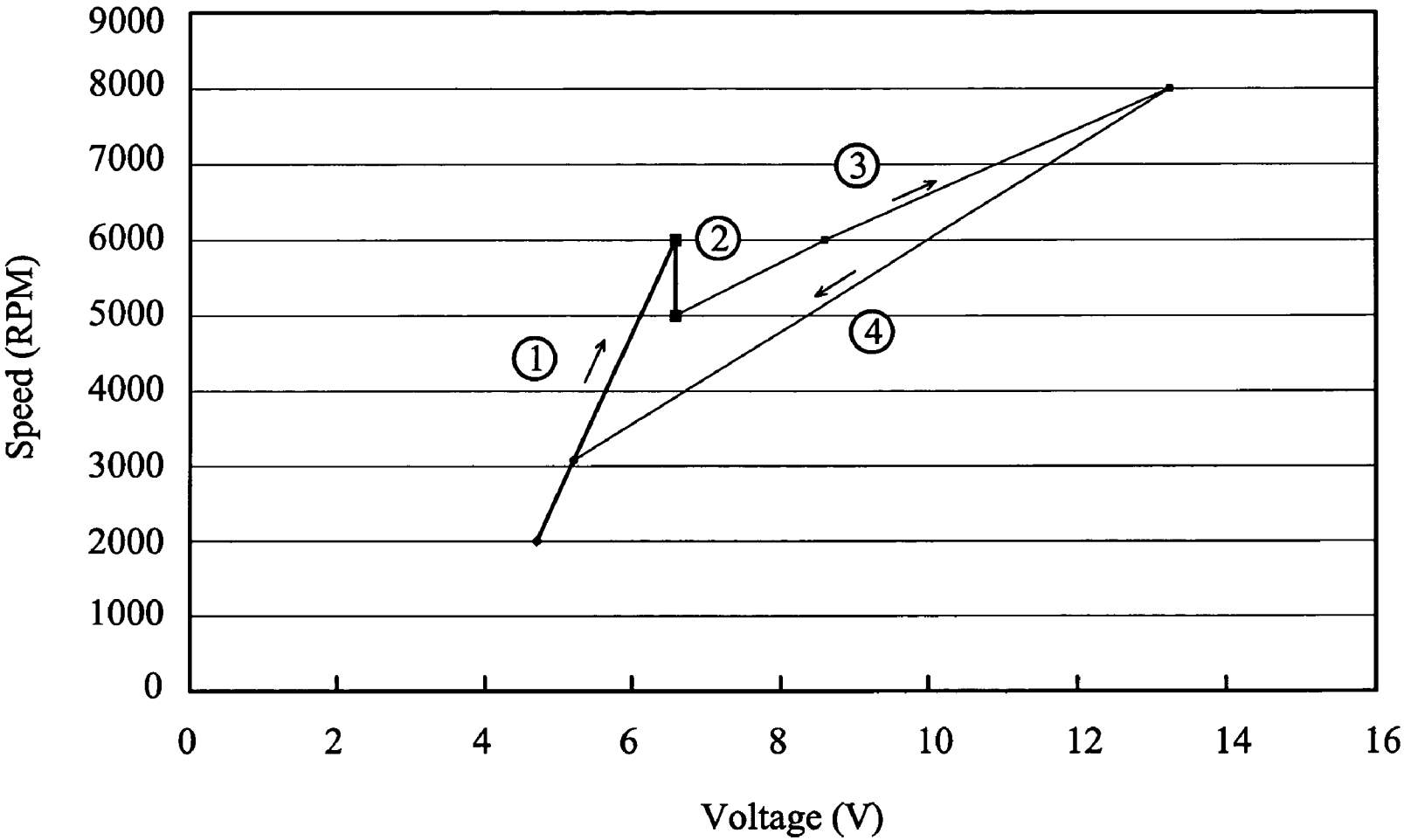
FIG. 4 depicts voltage and speed of the fan of the present invention.

Referring to FIGS. 3A, 3B and 4, details of operation principle of the fan 10/20 are described as below. As shown in FIG. 3A, when the impeller 16/26 is in a static state, the movable element 283 is attracted by the fixed element 282 and then the movable element 283 is located in a position (named as "first position") which is symmetrical to the fixed element 282 with respect to the rotating center X. At this time, the fan is in equilibrium.

When power is supplied to the fan, a magnetic force Fc, a centrifugal force F and a friction f are exerted on the movable element 283. When $F \leqq Fc+f$, the movable element 283 is maintained in the first position and in equilibrium, with no vibration occurring. Only heat dissipation function is provided, as shown in state 1 of FIG. 4.

Next, as the centrifugal force is proportional to the angular speed, the faster the impeller rotates, the larger centrifugal force is exerted on the movable element. When the impeller rotates fast enough, $F>Fc+f$, the movable element 283 slides away from the fixed element 282 along the track 284 to a second position, as shown in FIG. 3B. At this time, the impeller is unstable, and vibration occurs. Vibration notification is provided, as shown in state 2 of FIG. 4. The fan provides vibration and heat dissipation functions simultaneously, as shown in state 3 of FIG. 4.

When the rotational speed of the impeller is reduced, $Fc>F+f$, the movable element 283 slides along the track 284 back to the first position. The vibration vanishes, as shown in state 4 of FIG. 4, the impeller returns to equilibrium, and only heat dissipation is provided. The closed curve in FIG. 4 shows that the vibration state is reversible.

The movable element is moved by the rotational speed and located in different positions to turn the vibration function on or off so that the fan provides both heat dissipation and vibration notification functions.

Although the fixed element has the same shape, size or weight as the movable element in the above-mentioned embodiment, the fixed element can be different from the movable element in shape, size or weight. The fixed element and the movable element can be permanent magnets, and an attracting force is generated when the fixed element and the movable element are relatively disposed. In another embodiment, the fixed element is a permanent magnet, and the movable element is a soft magnet, or vice versa.

The number of the fixed elements can be greater than, less than or equal to the number of the movable elements. Some of the fixed elements and the movable element are soft magnets, and the others are permanent magnets. The sum of the number of the fixed elements and the movable elements are the same as or different from that of the tracks.

Figure 5:
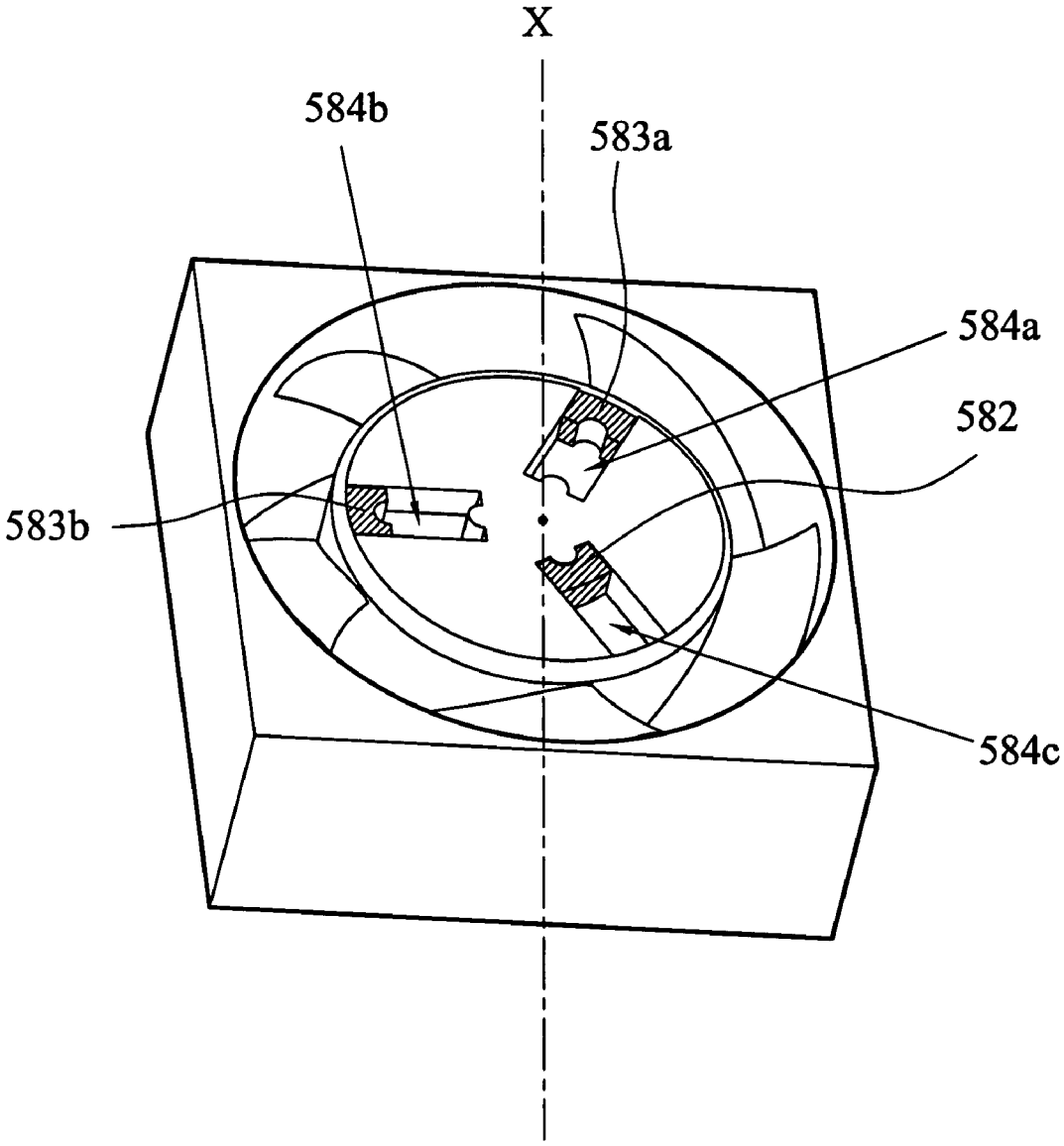
FIGS. 5 and 6 show another two vibration devices according to the preferred embodiment of the present invention.
Figure 6:
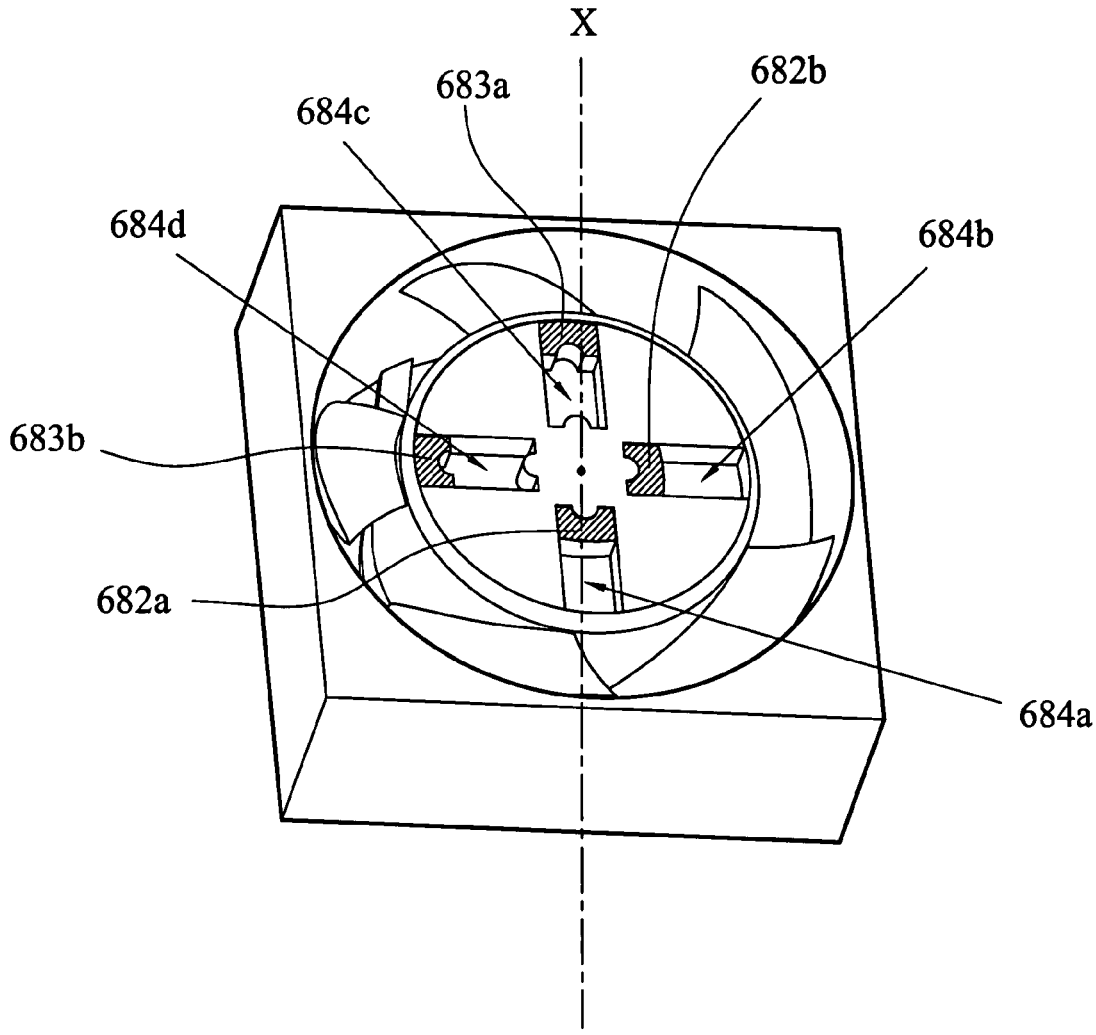

FIGS. 5 and 6 depict another two vibration devices according to the preferred embodiment of the present invention. Referring to FIG. 5, the number of the fixed element is less than the number of the movable elements. The vibration device in FIG. 5 includes one fixed element 582 and two movable elements 583*a* and 583*b*. The fixed element 582 and the movable elements 583*a* and 583*b* are disposed on tracks 584*a*, 584*b* and 584*c* respectively. In another embodiment, see FIG. 6, the number of the fixed elements is equal to the number of the movable elements. The vibration device in FIG. 6 includes two fixed elements 682*a*, 682*b* and two movable elements 683*a*, 683*b*. The fixed elements 682*a*, 682*b* and the movable elements 683*a*, 683*b* are disposed on tracks 684*a*, 684*b*, 684*c* and 684*d*, and the fixed elements 682*a*, 682*b* are symmetrical to the movable elements 683*a*, 683*b* with respect to a rotating center X of the impeller.

Figure 7:
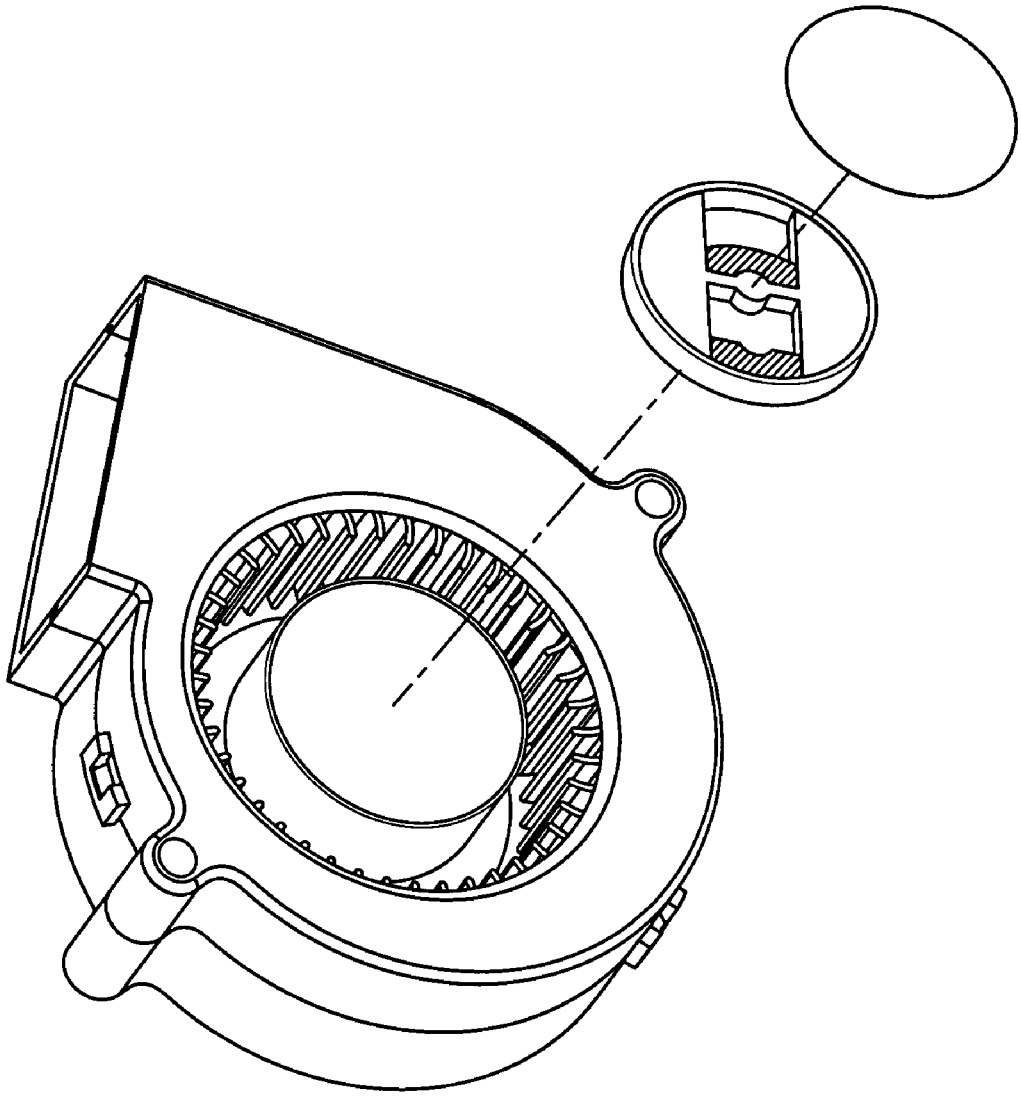
FIG. 7 is a schematic view of one another fan according to the preferred embodiment of the present invention.

In addition, in addition to an axial fan, the fan of the present invention can be a centrifugal fan, as shown in FIG. 7.

The fan of the present invention provides both vibration notification and heat dissipation functions. In addition, the vibration function is combined into the structural design of a fan, which reduces cost and space occupied by the whole system. The fan of the present invention can be so compact and light so that it can be applied to mobile phones, multimedia device or game machine.

While the present invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan, comprising:

a ventilation device comprising a housing, an impeller, and a driving mechanism, wherein the impeller and the driving mechanism are accommodated in the housing, and the driving mechanism is connected to the impeller and drives the impeller to rotate; and a vibration device disposed on the impeller and comprising at least one fixed element, at least one movable element, and at least two tracks, wherein the fixed element is fixed to one of the tracks, and the movable element is slidably disposed in the other of the tracks so as to generate a vibration notification.

2. The fan as claimed in claim 1, wherein the vibration device is integrally formed with the ventilation device as a single piece, or the vibration device is an individual device and joined to the ventilation device.

3. The fan as claimed in claim 2, wherein when the vibration device is integrally formed with the ventilation device as a single piece, the tracks are formed on the impeller and are disposed symmetrically with respect to a rotating center of the impeller.

4. The fan as claimed in claim 3, wherein the impeller comprises a hub and a plurality of blades disposed on a periphery of the hub, and the track is formed on the hub.

5. The fan as claimed in claim 4, wherein the blades are integrally formed with the hub as a single piece, and each blade has a gradually-rising profile.

6. The fan as claimed in claim 2, wherein when the vibration device is an individual device and joined to the ventilation device, the vibration device further comprises a base where the tracks are formed thereon, and the vibration device is connected to the ventilation device through the base.

7. The fan as claimed in claim 6, wherein the base comprises plastic, acrylic, ceramic, metal or alloy.

8. The fan as claimed in claim 6, wherein the tracks are disposed symmetrically with respect to a rotating center of the impeller.

9. The fan as claimed in claim 6, wherein the impeller comprises a hub and a plurality of blades disposed on the periphery of the hub, and the base is disposed on an upper surface of the hub of the impeller by attachment or adhesion, so that the vibration device is connected to the ventilation device.

10. The fan as claimed in claim 1, wherein a sum of number of the fixed element and the movable element is the same as a number of the tracks.

11. The fan as claimed in claim 1, wherein a number of the fixed element is greater than, equal to or less than a number of the movable element.

12. The fan as claimed in claim 1, wherein a shape, size, and weight of the fixed element are the same as or different from those of the movable element.

13. The fan as claimed in claim 1, wherein the fixed element and the movable element are permanent magnets, and an attracting force is generated when the fixed element and the movable element are relatively disposed.

14. The fan as claimed in claim 1, wherein the fixed element is a permanent magnet, and the movable element is a soft magnet, or vice versa.

15. The fan as claimed in claim 1, wherein the vibration device comprises a plurality of fixed elements and a plurality of movable elements, some of the fixed elements are soft magnets and the others are permanent magnets, and some of the movable elements are soft magnets and the others are permanent magnets.

16. The fan as claimed in claim 1, wherein the fixed element is fixed to one of the tracks by gluing, bonding or engaging.

17. The fan as claimed in claim 1, wherein the vibration device further comprises a cover which is disposed above the tracks and seals the tracks.

18. The fan as claimed in claim 17, wherein the impeller and the cover comprise plastic, acrylic, ceramic, metal or alloy.

19. The fan as claimed in claim 17, wherein the cover is fixed above the track by gluing, bonding or engaging.

20. The fan as claimed in claim 17, wherein the cover is a hard thin plastic sheet fixed above the tracks and seals the fixed element and the movable element in the tracks.

* * * * *